US007739990B2

(12) United States Patent
Tores et al.

(10) Patent No.: US 7,739,990 B2
(45) Date of Patent: Jun. 22, 2010

(54) METHOD AND APPARATUS FOR ADJUSTING ENGINE VALVE CLEARANCE

(75) Inventors: Lawrence S. Tores, Carson city, NV (US); Brad Rounds, Reno, NV (US)

(73) Assignee: T&D Machine Products, Inc., Carson City, NV (US)

( * ) Notice: Subject to any disclaimer, the term of this patent is extended or adjusted under 35 U.S.C. 154(b) by 597 days.

(21) Appl. No.: 11/731,137

(22) Filed: Mar. 30, 2007

(65) Prior Publication Data

US 2007/0227485 A1 Oct. 4, 2007

Related U.S. Application Data

(60) Provisional application No. 60/789,251, filed on Apr. 4, 2006.

(51) Int. Cl.
*F01L 1/18* (2006.01)

(52) U.S. Cl. ..... 123/90.39; 29/888.2; 74/559

(58) Field of Classification Search ..... 123/90.39, 123/90.44, 90.16, 90.27, 90.31; 74/559; 29/888.2

See application file for complete search history.

(56) References Cited

U.S. PATENT DOCUMENTS 2,880,711 A * 4/1959 Roan ..... 123/90.16
4,643,141 A * 2/1987 Bledsoe ..... 123/90.16
5,148,783 A * 9/1992 Shinkai et al. ..... 123/90.16
5,205,501 A * 4/1993 Alvarez ..... 241/189.1
6,712,031 B2 3/2004 Harada et al.

OTHER PUBLICATIONS

"Jim Cook Performance—Tech Notes—About Valve Lash", http://www.jimcookperformance.com/TechNotes/TN7ValvLash.html, Circa 2003, 5 pages.

Bill Marvel and Bill Scott, "The Rest of the Story", http://www.prime-mover.org/Engines/Marvel/tbo3.html, Circa 1998, 17 pages.

* cited by examiner

*Primary Examiner*—Ching Chang
(74) *Attorney, Agent, or Firm*—Weide & Miller, Ltd.

(57) ABSTRACT

A rocker arm is mounted to an eccentric shaft. The shaft has a pair of ends which are mounted to corresponding supports. The shaft has a rocker arm seat portion which is eccentric to the end portions, whereby when the position of the shaft is changed by rotating it, the position of the rocker arm changes. The shaft ends are mounted to riser blocks which are connected to a support structure. The shaft ends may be clamped in a fixed position relative to the riser blocks, or unclamped to permit the shaft to be rotated. When rotated, the position of the rocker arm may be changed up or down relative to the support structure and a valve stem which the rocker arm is intended to engage, thereby adjusting valve clearance.

20 Claims, 2 Drawing Sheets

50
20
24
26
36
34
28
22
32
30
46
44
48
40
40
42
38
36
30
52
34

METHOD AND APPARATUS FOR ADJUSTING ENGINE VALVE CLEARANCE

RELATED APPLICATION DATA

This application claims priority to U.S. Provisional Application Ser. No. 60/789,251, filed Apr. 4, 2006.

FIELD OF THE INVENTION

The present invention relates to methods and devices for adjusting engine valve clearance.

BACKGROUND OF THE INVENTION

Reciprocating piston internal combustion engines utilize valves to control the flow of intake air and exhaust to and from each cylinder or combustion chamber. The valves may be opened and closed in a variety of manners. In a common configuration, a stem extends from the valve. A spring biases the valve to a closed position and the free end of the stem is selectively depressed to move the valve to an open position. In one configuration, the stem is depressed with a rocker arm. The rocker arm is mounted for back and forth or rocking movement. When one end of the rocker arm is moved (such as directly by a camshaft or indirectly via a lifter/pushrod), the other end of the rocker arm selectively presses upon the stem and moves the valve.

Generally, a small gap is provided between the rocker arm and the stem. This gap is known as the valve clearance. Over time, the valve clearance will change. Among other things, wear of the stem and rocker arm may cause the valve clearance to increase. Changes in the valve clearance may result in accelerated wear and damage to engine components and change the valve opening timing. As such, it is desirable to maintain proper valve clearance.

A variety of rocker arm mounting configurations have been proposed, all of which have drawbacks. In one configuration, the rocker arm may be mounted to a threaded stud which extends out from a cylinder head of the engine. In this configuration, the rocker arm is generally free to float or move in every axis relative to the stud, as movement of the rocker arm is only indirectly constrained by devices that restrict the unwanted side-to-side movement of the lifter which actuates the rocker arm. Valve clearance may be adjusted by changing the position of the rocker arm along the threaded stud (moving the rocker arm up and down) and by securing the rocker arm in place using a threaded nut. This rocker arm mounting configuration has a number of drawbacks. First, it is difficult to position and secure the rocker arm in a desired position. Second, the rocker arm mounting allows for too much rocker arm movement, which is only acceptable for engines which operate at low speeds. Third, the trunnion is not rigidly fixed to the stud.

Another rocker arm mounting configuration is illustrated in FIGS. 1A and 1B. As illustrated, a rocker arm RA is mounted to a rocker shaft RS which is attached to a rigid base that is attached to a cylinder head of the engine. In this configuration, the rocker arm RA is only allowed to rotate in a single desired plane. This type of mounting thus works well in high engine speed applications.

However, valve clearance adjustment is complicated. As illustrated, the actuated end of the rocker arm RA includes a roller tip RT. The opposing actuating end of the rocker arm RA (which is configured to moved by a pushrod P which is actuated by a cam C via a lifter L) includes a jam nut N and adjusting screw AS. Movement of the adjusting screw AS relative to the rocker arm RA allows the valve clearance relative to a stem S of a valve V to be adjusted. One disadvantage to this configuration is that the adjusting screw AS is not only the adjustment mechanism, but comprises the point of engagement with the rocker arm RA. The adjusting screw AS is thus subject to extreme wear and tear at the same time as it is supposed to maintain an exacting position.

To overcome this problem, the adjusting screw is often removed to increase fatigue life, reduce weight and provide room for greater rocker arm ratios. In that case, however, clearance adjustment must be accomplished with yet another mechanism, such as a complex system of variable height hardened valve caps which are interchanged.

An improved rocker arm mounting configuration including valve clearance adjustment is desired.

SUMMARY OF THE INVENTION

The invention comprises a method and apparatus for adjusting valve clearance.

In one embodiment, a rocker arm is mounted to an eccentric shaft. The shaft has a pair of ends which are mounted to corresponding supports. The shaft has a rocker arm seat portion which is eccentric to the end portions, whereby when the position of the shaft is changed by rotating it, the position of the rocker arm changes.

In one embodiment, the shaft ends are mounted to riser blocks which are connected to a support structure, such as a base plate associated with a cylinder head. The shaft ends may be clamped in a fixed position relative to the riser blocks, or unclamped to permit the shaft to be rotated. When rotated, the position of the rocker arm may be changed up or down relative to the support structure and a valve stem which the rocker arm is intended to engage.

In one embodiment, the riser blocks are located in particular positions by engaging locator tabs on the support structure. Once positioned, the riser blocks may be secured with threaded fasteners.

The shaft preferably has a tool-engaging aperture formed in at least one end. A tool may thus be used to rotate the shaft to an infinite number of positions, thus changing the position of the associated rocker arm as desired.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a method and apparatus for adjusting valve clearance. In a preferred embodiment, the apparatus comprises an adjustable mounting configuration for a rocker arm.

Figure 1A:
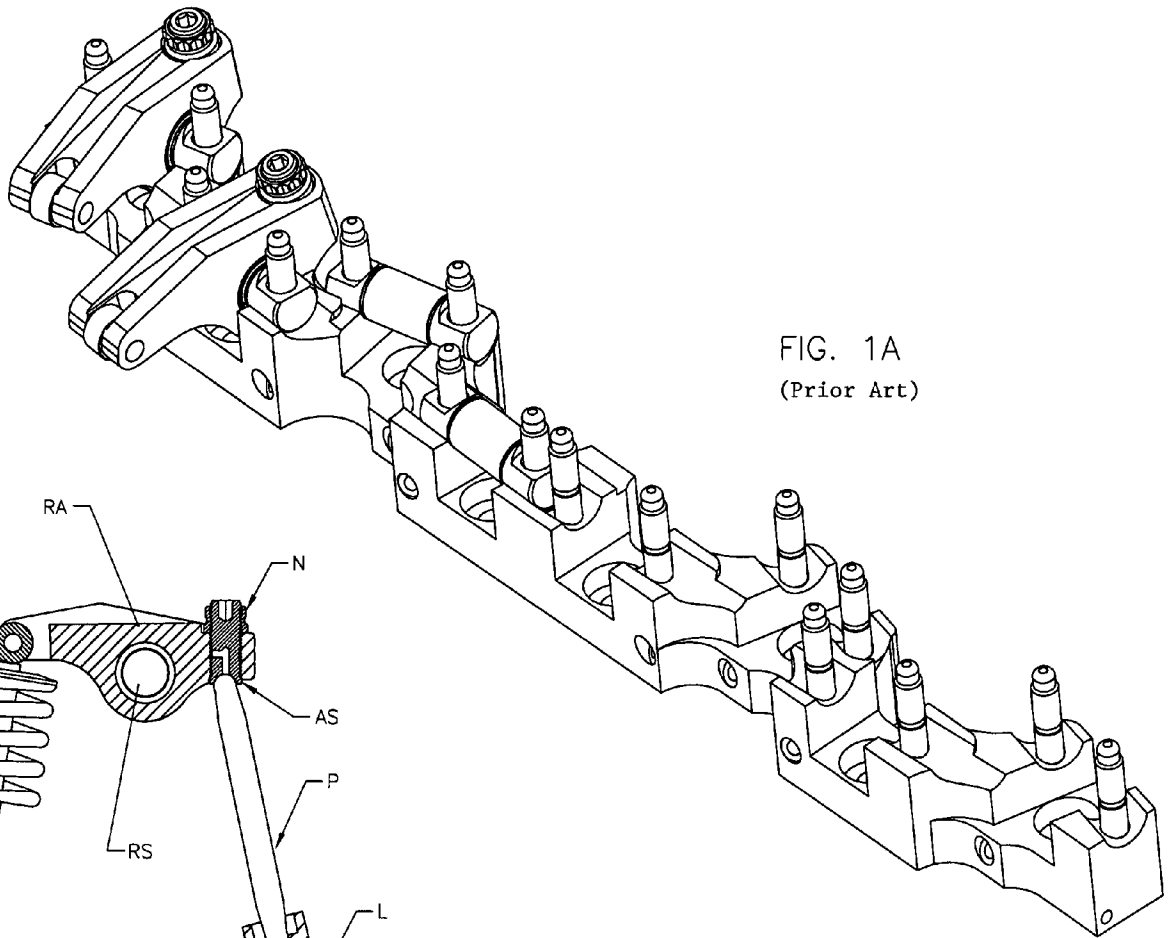
FIG. 1A (Prior Art)
FIGS. 1A and 1B illustrate a prior art rocker arm mounting configuration and having a prior art valve clearance adjustment configuration.
Figure 1B:
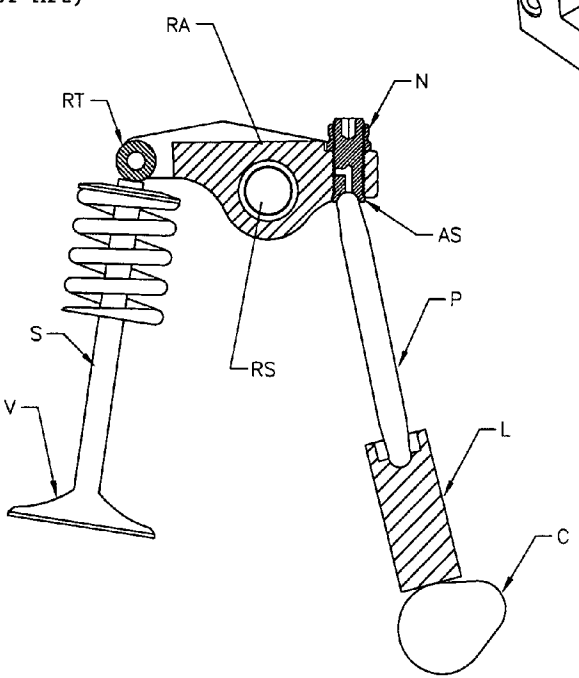
FIG. 1B (Prior Art)
Figures 2A, 2B, 2C:
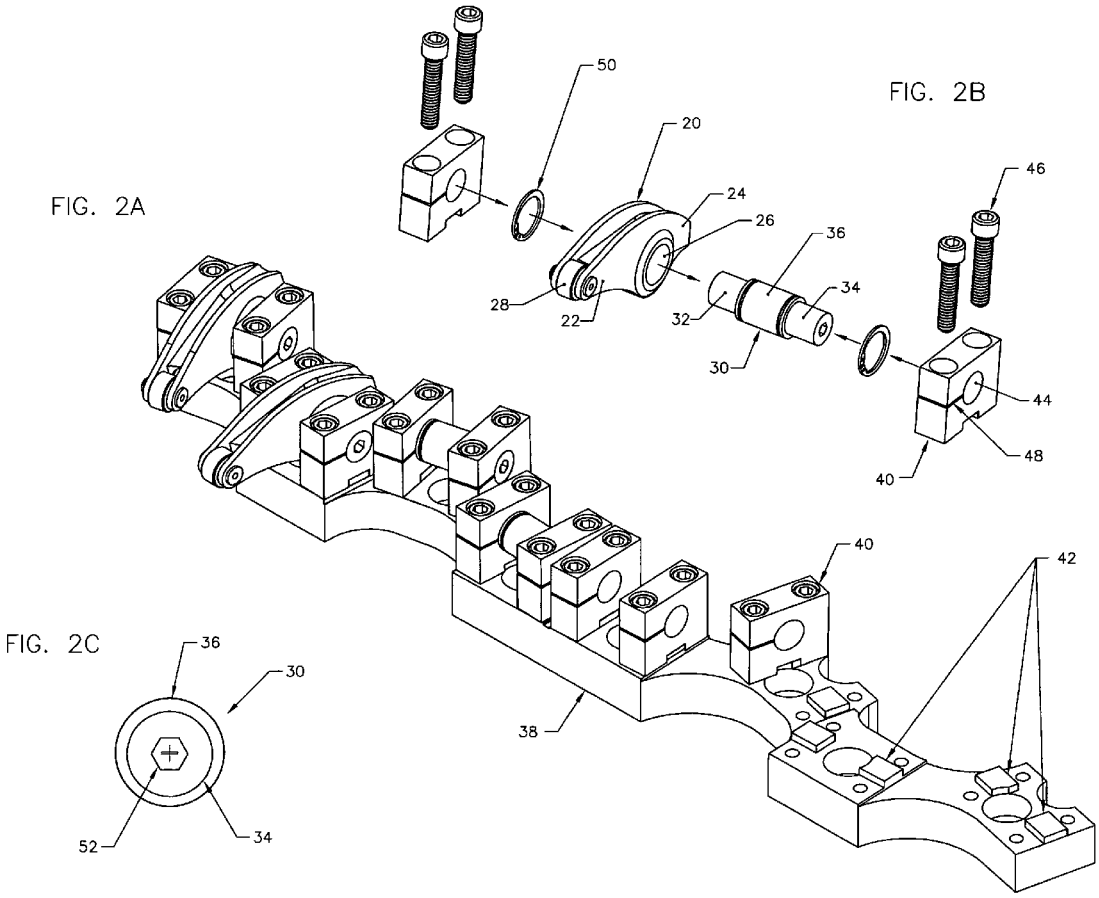
FIG. 2A-2C illustrate a rocker arm mounting configuration and valve clearance adjustment configuration in accordance with the present invention.

The invention will be described in more detail with reference to FIGS. 2A-2C. As best illustrated in FIG. 2B, a rocker arm 20 has an actuating end 22, an actuated end 24, and a mounting passage 26. In one embodiment, the actuating end 22 includes a roller tip 28 for engaging a valve stem (not shown).

The actuated end 24 is preferably configured to be engaged by a stem of a pushrod (not shown). In a preferred embodiment, the actuated end 24 does not include an adjusting screw and corresponding nut or any other type of adjusting mechanism.

The rocker arm 20 is configured to be mounted to a rocker arm mounting shaft 30 by location of a seat portion 36 of the shaft 30 in the mounting passage 26. The rocker arm 20 is preferably mounted to the shaft 30 about a bearing, whereby when the rocker arm 20 is mounted to the shaft 30, it may move (rock back and forth) relative to the shaft 30.

In one embodiment, the shaft 30 includes first and second ends or mounting or clamping portions 32,34, and a rocker arm seat portion 36. As illustrated, the seat portion 36 is preferably located intermediate or between the ends 32,34.

Means are provided for mounting the shaft 30 to a support structure. In one embodiment, as illustrated in FIG. 2A, the shaft 30 is configured to be mounted to an engine, such as to a cylinder head thereof or a base or mounting plate 38 which is mounted thereto. In one embodiment, the mounting means comprise a one or more supports, such as first and second riser or mounting blocks 40.

Each riser block 40 preferably comprises a body having a base for engaging a corresponding support surface. In one embodiment, each riser block 40 includes a first key configured to engage a mating second key associated with support to which the riser block 40 is to be mounted. In one embodiment, each riser block 40 may include a notched or recessed area for accepting a corresponding locator tab 42 which is associated with the supporting or mounting surface. In this manner, each riser block 40 may be keyed to mount in a specific location. Of course, the riser blocks 40 may be keyed in other fashions, such as by being configured to be located in a recessed area (rather than accepting a raised key) or by having an outwardly extending key (such as one or more pins) for engaging mating slots, apertures or the like in the support structure, or by use of fasteners or the like which fix the riser blocks 40 in specific positions.

Means are preferably provided for securing the riser block 40 to the support or mounting surface in the designated position. In one embodiment, a pair of threaded fasteners 46 extends through passages in the block 40 from a top to the base thereof, and into engagement with the mounting surface. As illustrated, the fasteners 46 may be threaded studs having a hex or Allen type head. Of course, other securing means might be provided, such as other types of fasteners, direct mechanical connections or combinations thereof.

Each riser block 40 has a passage 44 there through for accepting one of the mounting portions or ends 32,34 of the rocker arm support shaft 30. In one embodiment, a slot 48 is provided in each riser block 40, the slot extending 48 through the body of the block 40 from the passage 44 to the exterior thereof, thereby permitting the size of the passage 44 to be adjusted (expanding when the fasteners 46 are loosened and contracting or reducing tightly about the shaft 30 when the slot is compressed as the fasteners 46 are tightened). Instead of passages, one or both riser blocks 40 might include openings for accepting the ends 32,34 of the shaft 30. It will also be appreciated that the riser blocks 40 could be formed in two pieces, much like a crank-shaft bearing, with a base and a top bridge which is affixed over the end of the shaft.

In accordance with the invention, means are provided for selectively adjusting valve clearance. In a preferred embodiment, this comprises means for changing the position of the rocker arm 20. In a preferred embodiment, as best illustrated in FIG. 2C, the seat portion 36 of the rocker arm mounting shaft 30 is eccentric relative to the remaining portion of the shaft. In a preferred embodiment, the end portions 32,34 of the shaft 30 are generally cylindrical in shape (and circular in cross section) and extend or are positioned along a first centerline. The seat portion 36 is similarly cylindrical in shape (and circular in cross-section), but extends or is positioned along a second centerline which is offset from the first centerline. Thus, when the ends 32,34 of the shaft 30 are mounted to a pair of riser blocks 40 and a rocker arm 20 is mounted upon the seat portion 36, a change in the radial position of the shaft 30 relative to the riser blocks 40 changes the distance which the rocker arm 20 is positioned above the support or mounting surface.

In one embodiment, means are provided for changing the position of the shaft 30, and thus the rocker arm 20. As illustrated, at least one of the ends 32,34 of the shaft 30 preferably defines a hex-head opening 52 for accepting a hex-head tool, such as an Allen-wrench. Rotation of the shaft 30 with the tool causes the position of the rocker arm 20 to change. The shaft 30 could have other tool-engaging means, such as an outwardly extending head.

Use of the apparatus and various advantages of the invention will now be described. One or more rocker arms 20 are mounted to corresponding shafts 30. Each shaft 30 is mounted to a support structure, preferably with a pair of riser blocks 40. Each riser block 40 is preferably mounted in a particular position by mating it with at least one corresponding locator tab 42. Once positioned, the fasteners 46 are utilized to secure the riser blocks 40 the support structure. Valve clearance may be adjusted by changing the position of each rocker arm 20 relative to its corresponding valve stem (not shown). In particular, the fasteners 46 are loosened sufficiently to allow the shaft 30 to rotate. A tool is then used to turn the shaft relative to its pair of riser blocks 40, moving the corresponding rocker arm 20 up or down, until the correct valve clearance is obtained. The position of the shaft 30, and thus the rocker arm 20, is secured by clamping the shaft 30 in a fixed position by tightening the fasteners 46 associated with the riser blocks 40. If the valve clearance needs to be adjusted in the future, the position of the shaft 30 may be changed by loosening the fasteners 46 and then rotating the shaft 30.

In a preferred embodiment of the invention, the above-described configuration is used in association with an internal combustion engine where the actuator end of the rocker arm is used to move a valve. In such an embodiment, as illustrated, a plurality of rocker arms may be mounted to move a plurality of valves. Each rocker arm is preferably mounted independent of the other, whereby the position of each rocker arm, and thus associated valve clearance, may be independently adjusted.

In accordance with the invention, a rocker arm is mounted in a constrained fashion to a corresponding shaft. In particular, the rocker arm is mounted so that it can only move in one plane as it rotates or rocks about the shaft. The shaft is similarly constrained relative to a support structure, whereby the shaft does not move. The shaft is mounted to riser blocks which are secured in a fixed position to the support structure. In this manner, the rocker arm mounting supports very high speed engine applications.

In addition, the position of the rocker arm can be controlled to very exacting tolerances. First, each riser block is secured in a specific, fixed position, such as by using a locator tab. The shaft is secured to the riser blocks in a compression fit mount. Further, the valve clearance can be controlled by rotating the shaft into an infinite number of positions, thus allowing the rocker arm to be mounted in an infinite number of positions.

Of course, the amount of adjustment which is permitted may be adjusted by changing the amount of shaft eccentricity. In particular, the center axis of the rocker arm seat portion may be offset by greater or lesser distances relative to the center axis of the mount portions, thus changing the maximum distance which the rocker arm may be moved as a result of a change of position of the shaft.

It will be understood that various aspects of the invention may be utilized separate from the others. For example, the riser block mounting configuration may be used to locate the shafts and rockers arms in exacting positions even when the shafts are not eccentric. In addition, eccentric shafts may be utilized though they may be mounted in other fashions.

In one embodiment, both the shaft ends and the seat portion are generally circular in shape, but their central axes are offset so as to be eccentric. In other embodiments, at least the seat portion may be other than circular in cross-section, such as irregular in shape (having portions which extend radially outwardly from a central axis by different distances). For example, the seat portion may be cam-like in configuration. In another embodiment, the seat portion may be circular in cross-section but the shaft ends may be irregular or cam-like. In this manner, when the shaft is rotated to different positions, the position of the rocker arm changes, such as by moving up and down to thereby change valve clearance.

As indicated above, in a preferred embodiment, the portions of the rocker arm mounting shaft are generally cylindrical. In one embodiment, one or more portions of the rocker arm mounting shaft have a radius which is greater than or less than a radius of the end portions of the shaft.

The rocker arm mounting shaft may be mounted in a variety of fashions. In one embodiment, only one of the ends of the shaft is configured to be tightened into a fixed position (rather than both ends). In one embodiment, a portion of the shaft mount may be defined by the base plate or engine itself. For example, the base plate may define an upwardly extending support. An end of the rocker arm mounting shaft may be configured to rest upon this support. A locking element, such as a mounting block, may be configured to be positioned over a top portion of the shaft and compress the end of the shaft against the support, thus maintaining it in position. In this configuration, the mounting block might be "U" or "C" shaped and configured to generally define only a portion of the aperture or passage in which the end of the shaft is located, rather than be a block which defines the entire passage or aperture.

The riser or mounting blocks might also be connected to the base plate or engine in other fashions, such as with clamps or other elements.

As illustrated, means may be provided for fixing the rocker arm onto the shaft. In one embodiment, a pair of grooves is formed in the seat portion of the rocker arm mounting shaft. Once the rocker arm is mounted on the shaft, a lock ring 50 is positioned at opposing sides thereof. Each locking ring 50 engages one of the grooves, thus positioning the rocker arm there between.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A rocker arm mounting configuration comprising:

a first mounting block and a second mounting block spaced from one another, each mounting block having a shaft-accepting aperture therein;

a rocker arm mounting shaft, said shaft having a first end and a second end and a rocker arm seat portion, said first and second ends located along a first centerline and said rocker arm seat portion located along a second centerline which is offset from said first centerline, a position of said second centerline relative to said first centerline being variable depending upon a selected mounting position of said rocker arm mounting shaft from a plurality of mounting positions and wherein said first and second ends of said rocker arm mounting shaft are connected to said first and second mounting block in fixed positions corresponding said selected one of said mounting positions of said rocker arm mounting shaft; and a rocker arm positioned on said seat portion of said shaft, at least a valve-stem engaging portion of said rocker arm moveable relative to said seat portion of said shaft, wherein a position of said rocker arm relative to said first centerline is fixed as determined by said selected one of said mounting positions of said rocker arm mounting shaft.

2. The rocker arm mounting configuration in accordance with claim 1 wherein said first and second mounting blocks each have a bottom defining a tab-engaging aperture therein for accepting a locator tab.

3. The rocker arm mounting configuration in accordance with claim 2 further including a base, said base defining a first outwardly extending locator tab for positioning in said tab-engaging aperture in said first mounting block and a second outwardly extending locator tab for positioning in said tab-engaging aperture in said second mounting block.

4. The rocker arm mounting configuration in accordance with claim 1 wherein a tool-engaging aperture is formed in at least said first or second end of said rocker arm mounting shaft.

5. The rocker arm mounting configuration in accordance with claim 1 wherein a slot extends through said first mounting block to said shaft-accepting aperture there through and a slot extends through said second mounting block to said shaft-accepting aperture there through.

6. The rocker arm mounting configuration in accordance with claim 1 including at least one fastener associated with said first mounting block configured to tighten said first mounting block about said first end of said rocker arm mounting shaft to retain said first end of said rocker arm mounting shaft in said fixed position and at least one fastener associated with said second mounting block configured to tighten said second mounting block about said second end of said rocker arm mounting shaft to retain said second end of said rocker arm mounting shaft in said fixed position.

7. The rocker arm mounting configuration in accordance with claim 1 wherein said first end, second end and seat portion of said rocker arm mounting shaft are generally cylindrical in shape.

8. The rocker arm mounting configuration in accordance with claim 7 wherein a radius of at least one portion of said seat portion of said rocker arm mounting shaft exceeds a radius of said rocker arm mounting portion at said first end or said second end.

9. The rocker arm mounting configuration in accordance with claim 1 wherein said rocker arm has said valve stem engaging portion configured to actuate a valve, and an actuated end configured to be actuated by a pushrod, said actuated end being non-adjustable.

10. A method of adjusting valve clearance comprising:

providing a rocker arm mounting shaft having a first mounting portion, a second mounting portion and a rocker arm seat portion, said first and second mounting portions positioned along a first centerline and said seat portion having a second centerline offset from said first centerline, said rocker arm mounting shaft capable of being positioned in a plurality of mounting positions, each mounting position defining a position of said second centerline relative to said first centerline, a rocker arm mounted on said rocker arm seat portion of said rocker arm mounting shaft, said position of said rocker arm relative to said first centerline determined by said mounting positions of said rocker arm mounting shaft;

selecting one of said mounting positions of said rocker arm mounting shaft;

mounting said first mounting portion of said rocker arm mounting shaft to a first support and mounting said second mounting portion of said rocker arm mounting portion to a second support in positions corresponding to said selected one of said mounting positions of said rocker arm mounting shaft; and fixing said positions of said first and second mounting portions of said rocker arm mounting shaft to maintain said selected one of said mounting positions of said rocker arm mounting shaft and thus the position of said rocker arm.

11. The method in accordance with claim 10 wherein said step of selecting one of said mounting positions comprises rotating said rocker arm mounting shaft to a desired position.

12. The method in accordance with claim 10 further comprising the step of mounting said first and second supports to an engine.

13. The method in accordance with claim 12 wherein said step of mounting said first and second supports comprises mounting said first and second supports to a base plate mounted to an engine.

14. The method in accordance with claim 10 wherein said step of mounting said first and second mounting portions of said rocker arm mounting shaft comprises locating a first end of said shaft in an aperture defined by said first support and locating a second end of said shaft in an aperture defined by said second support.

15. The method in accordance with claim 14 wherein said step of fixing said positions comprises tightening said first and second supports about said first and second ends of said shaft, respectively, to fix the positions of said first and second ends of said shaft relative to said first and second supports.

16. An internal combustion engine having at least one variable volume combustion chamber having at least one intake or exhaust port having a valve controlling flow of gasses there through, and including a valve actuating device with valve clearance adjustment, comprising:

a base mounted to a portion of said engine, said base including at least a first key element and a second key element;

a first support mounted to said base, a key element of said first support engaging said first key element of said base;

a second support mounted to said base, a key element of said second support engaging said second key element of said base;

a rocker arm mounting shaft, said shaft having a first end and a second end and a rocker arm seat portion, said first and second ends located along a first centerline and said rocker arm seat portion located along a second centerline which is offset from said first centerline, a position of said second centerline relative to said first centerline being variable depending upon a selected mounting position of said rocker arm mounting shaft from a plurality of mounting positions and wherein said first and second ends of said rocker arm mounting shaft are connected to said first and second supports in fixed positions corresponding said selected one of said mounting positions of said rocker arm mounting shaft; and a rocker arm positioned on said seat portion of said shaft, at least a valve-stem engaging portion of said rocker arm moveable relative to said seat portion of said shaft, wherein a position of said rocker arm relative to said first centerline is fixed as determined by said selected one of said mounting positions of said rocker arm mounting shaft.

17. The engine in accordance with claim 16 wherein said first key element of said base comprises an outwardly extending tab and said second key element of said base comprises an outwardly extending tab.

18. The engine in accordance with claim 16 including at least one first fastener connecting said first support to said base and fixing a position of said first end of said rocker arm mounting shaft to said first support and at least one second fastener connecting said second support to said base and fixing a position of said second end of said rocker arm mounting shaft to said second support.

19. The engine in accordance with claim 16 wherein said engine includes a first valve and a second valve, said first valve having first and second supports, a rocker arm mounting shaft and a rocker arm corresponding thereto, and said second valve having first and second supports, a rocker arm mounting shaft and a rocker arm corresponding thereto.

20. Th engine in accordance with claim 19 wherein said first and second supports corresponding to said first valve are connected to said base in a first position and said first and second supports corresponding to said second valve are connected to said base in a second position.

* * * * *